US009279305B2

(12) United States Patent
Linklater et al.

(10) Patent No.: US 9,279,305 B2
(45) Date of Patent: Mar. 8, 2016

(54) DOWNHOLE TOOL AND METHOD

(75) Inventors: James Linklater, Buckie (GB); George Telfer, Aberdeen (GB)

(73) Assignee: M-I Drilling Fluids UK Limited, Aberdeen (GB)

( * ) Notice: Subject to any disclaimer, the term of this patent is extended or adjusted under 35 U.S.C. 154(b) by 268 days.

(21) Appl. No.: 13/637,180

(22) PCT Filed: Mar. 15, 2011

(86) PCT No.: PCT/GB2011/050506

§ 371 (c)(1), (2), (4) Date: Mar. 18, 2013

(87) PCT Pub. No.: WO2011/117606

PCT Pub. Date: Sep. 29, 2011

(65) Prior Publication Data

US 2013/0168087 A1 Jul. 4, 2013

(30) Foreign Application Priority Data

Mar. 25, 2010 (GB) ..... 1005033.4

(51) Int. Cl.

| | |
|---|---|
| ***E21B 33/12*** | (2006.01) |
| ***E21B 33/128*** | (2006.01) |
| ***E21B 47/10*** | (2012.01) |
| ***E21B 49/00*** | (2006.01) |

(52) U.S. Cl.

CPC ..... *E21B 33/128* (2013.01); *E21B 33/12* (2013.01); *E21B 47/1025* (2013.01); *E21B 49/00* (2013.01)

(58) Field of Classification Search

USPC ..... 166/250.17, 387, 196, 250.08, 337, 166/138, 239, 123, 125

See application file for complete search history.

(56) References Cited

U.S. PATENT DOCUMENTS

| | | | | |
|---|---|---|---|---|
| 3,122,205 | A * | 2/1964 | Brown et al. | 166/122 |
| 4,262,702 | A | 4/1981 | Streich | |
| 4,469,173 | A * | 9/1984 | Gilbert et al. | 166/188 |
| 4,537,251 | A | 8/1985 | Braddick | |
| 4,567,944 | A | 2/1986 | Zunkel et al. | |
| 5,103,901 | A | 4/1992 | Greenlee | |
| 5,692,564 | A * | 12/1997 | Brooks | 166/127 |
| 6,167,970 | B1 * | 1/2001 | Stout et al. | 166/377 |
| 6,896,064 | B2 | 5/2005 | Howlett et al. | |

(Continued)

FOREIGN PATENT DOCUMENTS

| | | |
|---|---|---|
| GB | 2309988 A | 8/1997 |
| WO | 0183938 A1 | 11/2001 |

(Continued)

OTHER PUBLICATIONS

International Search Report and Written Opinion issued in PCT/GB2011/050506 on May 2, 2012, 9 pages.

*Primary Examiner* — Taras P Bemko

(57) ABSTRACT

A downhole packer for providing a seal in a well bore to allow integrity testing of well bore with drill ahead capability immediately thereafter has a disengageable packer assembly wherein the packer element may be rendered disengageable by mounting the packer to the string using a tool body (61) provided with a sleeve (62) bearing a packer element (55), wherein the body is initially restrained from movement within the sleeve by engagement of an internal selectively movable retaining element (64). A method of testing a well bore with follow on drilling after disengaging the packer element is described.

6 Claims, 5 Drawing Sheets

(56) References Cited

U.S. PATENT DOCUMENTS

| | | | | |
|---|---|---|---|---|
| 7,650,946 | B2 * | 1/2010 | Gazewood | 166/377 |
| 2003/0019623 | A1 | 1/2003 | King et al. | |
| 2003/0132007 | A1 * | 7/2003 | Howlett et al. | 166/387 |
| 2004/0055757 | A1 * | 3/2004 | Beall | 166/382 |
| 2006/0243455 | A1 * | 11/2006 | Telfer et al. | 166/386 |
| 2009/0025927 | A1 * | 1/2009 | Telfer | 166/174 |

FOREIGN PATENT DOCUMENTS

| | | | |
|---|---|---|---|
| WO | 03097993 | A2 | 11/2003 |
| WO | 2005106186 | A1 | 11/2005 |

* cited by examiner

DOWNHOLE TOOL AND METHOD

FIELD OF THE INVENTION

The present invention relates to a downhole tool adapted to be attached to a workstring, especially a drill string. More particularly, the present invention relates to a downhole tool adapted for providing a seal between the well tubing and the well bore in order to permit performance of a downhole testing procedure with the facility to resume immediate continuance of drilling operations.

BACKGROUND TO THE INVENTION

In the drilling and production of oil and gas wells, it is typical to prepare a well bore in a target oil or gas-bearing formation using a drill string which is terminated by a drill bit. The drill string is rotated to remove formation ahead of the drill bit, to drill and thus form a wellbore, and to increase the depth of the well. The drill string has an axial throughbore throughout its length which provides a fluid circulation path through the string and BHA and back up the annulus around the string within the well bore.

Drilling mud or other fluid is pumped through the drill string to cool the drill bit, and to aid the passage of drill cuttings from the base of the well to the surface, via an annulus formed between the drill string and the wall of the wellbore.

At fixed intervals, the drill bit is removed from the wellbore and a casing comprising lengths of tubular casing sections coupled together end-to-end is run into the drilled wellbore and cemented in place. A smaller dimension drill bit is then inserted through the cased wellbore, to drill through the formation below the cased portion, to thereby extend the depth of the well. A smaller diameter casing is then installed in the extended portion of the wellbore and also cemented in place. If required, a liner comprising similar tubular sections coupled together end-to-end may be installed in the well, coupled to and extending from the final casing section. Once the desired full depth has been achieved, the drill string is removed from the well and then a work string is run-in to clean the well. Once the well has been cleaned out, the walls of the tubular members forming the casing/liner are free of debris so that when screens, packers, gravel pack assemblies, liner hangers or other completion equipment is inserted into the well, an efficient seal can be achieved between these devices and the casing/liner wall.

It is important to determine whether there are any cracks, gaps or other irregularities in the lining of a well bore, or in the cement between tubulars which line a well bore, which may allow the ingress of well bore fluid into the annulus of the bore. It is also important that any irregularities in the well bore casing connections and cement bonds are identified and monitored to prevent contamination of the well bore contents.

It is normally difficult to determine whether there are any irregularities in the well bore casing connections and cement bonds as the hydrostatic pressure created by drilling fluid within the well bore prevents well bore fluid from entering the annulus of the bore. In order to overcome this difficulty it is known to the art to use downhole packers to seal off sections of a pre-formed well bore in order to test the integrity of the particular section of bore. One test carried out to identify any such irregularities is a so-called "in-flow" or "negative" test During an in-flow test a packer is included on a work string and run into a bore. The individual packer elements of the packer tool are expanded to seal the annulus between the well tubing (casing or lining) and tool in the well bore. Expansion or "setting" of the packer is usually achieved by rotating the tool relative to the work string and the set packer thereafter prevents the normal flow of drilling fluid in the annulus between the work string and well bore tubular. A lower density fluid is then circulated within the work string which reduces the hydrostatic pressure within the pipe. As a consequence of the drop in hydrostatic pressure, well bore fluid can flow through any cracks or irregularities in the lining of the well bore into the annulus of the bore. If this occurs, the flow of well bore fluid into the bore results in an increase in pressure which can be monitored. As a result it is possible to locate areas where fluid can pass into the well bore through irregularities in the structure of the bore and where repair of the lining may be required. After testing, the bore may be "pressured up" to remove the well bore fluid from the bore and a heavy drilling fluid can be passed through the string to return the hydrostatic pressure to normal.

Typically, a separate trip is required to be made into the well to perform an in-flow or negative pressure test. This is because the conventional packer tools used are set by a relative rotation within the well bore. As many other tools are activated by rotation and indeed as the drill string itself would normally be rotated during this type of operation, it is likely that the packer would prematurely set. This problem has been overcome by the introduction of a weight-set packer. Such a weight-set packer, also referred to as a "compression-set packer", is disclosed in the Applicant's International Patent Application, publication no. WO/0183938 which is hereby incorporated by reference. The packer is set by a sleeve moveable on a body of the packer being set down on a formation in the well bore. Movement of the sleeve compresses one or more packing elements to provide a seal.

This compression-set packer is particularly suitable for integrity testing of a liner when a permanent packer, or 'tie-back' packer, with a Polished Bore Receptacle (PBR) has been used. Once the permanent packer with the PBR has been set, a single trip can be made into the well to operate clean-up tools and perform an in-flow or negative test. The clean-up tools may be operated by relative rotation of the work string in the well-bore and further the work string can be slackened off so that the sleeve of the compression-set packer lands out on the PBR. This sets the compression-set packer above the PBR and seals the bore between the packers. An in-flow or negative test can then be performed.

SUMMARY OF THE INVENTION

Notwithstanding the improvements already made in such tools, there is an interest in being able to drill ahead immediately after performing such an in-flow test.

Whilst the compression or weight-set packer is set the drill string should not be rotated for drilling purposes, and it is normally necessary to lift the drill string to back-off the set weight to allow the compressed packer elements to relax to a non-expanded configuration, and pull out of hole to remove the test tool and attach a different drill assembly to the string for further drilling beyond the cased or lined well bore.

Such pull out and re-entry presents a disproportionate time loss, which translates directly into cost, when in some cases the additional drilling necessary may only be a matter of 10 metres or so further penetration into the formation. Thus the ability to resume drilling directly after testing is a desirable object in the field.

According to the present invention, this object is achievable by the tool to be more particularly described hereinafter, which provides a packer element configured to be disengaged from a tool body e.g. by use of a pressure activated mechanism.

Disengaging the packer element from the tool body enables the unhindered movement of the drill string for the purposes of drilling ahead immediately after the testing procedure has been completed.

This avoids the need to recover the drill string to surface for removal of the test tool and attachment of a different drill assembly and the subsequent run in hole again to resume drilling below the liner top or the like pressure tested zone.

According to the invention, the packer element may be rendered disengageable by mounting the packer to the string using a tool body provided with a packer sleeve bearing a packer element, wherein the body is initially restrained from movement within the packer sleeve by engagement of a selectively movable retaining element therebetween.

The selectively movable retaining element may be mounted within the packer body and configured to engage directly with a corresponding surface of the packer, in the first configuration.

The selectively movable retaining element may be mounted within the packer body and configured to engage indirectly through another movable component with a corresponding surface of the packer, in the first configuration.

The selectively movable component could be moved by use of wedges, ramp or cam surfaces or by spring force for example, and activated by a pressure change event. Conveniently, this event would typically be enabled by provision of a moveable inner sleeve including a valve seat adapted to cooperate with an obturator normally delivered to the seat through the string under gravity or pumped down in the circulating fluid.

As is understood in the art, using such an obturator upon a suitable valve seat inhibits flow of the circulating fluid, which causes a pressure build-up behind the valve (upstream), and this pressure build-up can be used to cause a component to be selectively displaced e.g. by use of shear fasteners designed to yield when a selected pressure is reached, or use of springs the biasing of which will be overcome when a selected pressure is reached.

According to an aspect of the invention there is provided a disengageable compression or weight-set packer adapted for attachment to a drill string having an axial throughbore throughout its length, and comprising a packer body having a corresponding throughbore, an external packer sleeve positioned upon the packer body such that relative movement of the body with respect to the sleeve is restrained by a selectively movable retaining element, at least one compressible packer element around an outer surface of the packer sleeve, and an activation means for selectively moving the component to disengage the retaining element and allow movement of the body within the packer sleeve.

According to another aspect of the invention, there is provided a downhole packer tool for mounting upon a work string, the packer tool comprising a body with one or more compressible packer elements and a compression sleeve, wherein the compression sleeve has or is associated with a shoulder and is moveable in relation to the tool body, wherein the shoulder co-operates with a formation within a well bore, wherein upon co-operation with the formation, the compression sleeve can be moved relative to the tool body by setting down weight on the tool, and wherein movement of the compression sleeve relative to the tool body compresses the one or more packer elements, and further wherein the body has a throughbore, an external packer sleeve positioned upon the body such that relative movement of the body with respect to the packer sleeve is restrained by engagement of a selectively movable retaining element therebetween, at least one compressible packer element around an outer surface of the packer sleeve, and an activation means for selectively moving the retaining element to allow movement of the body within the packer sleeve.

According to another aspect of the invention, there is provided a disengageable packer assembly for a tool body adapted for mounting on drill string, said packer assembly including a packer body having a throughbore, an outer packer sleeve positioned upon the packer body such that relative movement of the body with respect to the packer sleeve is restrained by engagement of a selectively movable retaining element therebetween, at least one compressible packer element around an outer surface of the packer sleeve, an inner sleeve movable within the throughbore from a first to a second position, said inner sleeve being restrained in the first position during setting of the packer, and releasable thereafter for the purposes of disengaging the packer body from the outer packer sleeve to allow movement of the packer body relative to said outer packer sleeve.

The inner sleeve used for activation of the mechanism for disengaging the packer sleeve from the packer body may comprise a valve seat positioned within the inner sleeve and aligned with the throughbore to receive an obturator delivered in circulating fluid in the course of use of the tool. The inner activation sleeve may have a cross-section sized to interact with an inner diameter restriction within the throughbore so that the extent of axial travel within the throughbore is limited between two positions, a first position when no obturator is seated upon the valve seat, and fluid can be circulated freely, and a second position reached after displacement due to a fluid pressure increase when an obturator is seated upon the valve seat to obstruct fluid circulation. The activation sleeve may be held in the first position initially by shear fasteners designed to yield at a particular pressure developed by fluid upon the obturator and valve seat when the obturator is seated thereon.

The inner activation sleeve may be configured with surfaces adapted to cooperate with a selectively movable retaining element or keying component to cause movement thereof with respect to a cooperating surface or recess in the packer body to effect disengagement of the element or component from the cooperating surface or recess.

According to one aspect, the activation sleeve may be provided with a wedge, cam surface or ramp inclined relative to a main axis of the packer tool to drive a pin radially through an aperture in the packer body. According to another aspect, the activation sleeve has a stepped surface allowing a movable retaining element or keying component to drop into a recess whenever the activation sleeve is translated axially relative to the retaining element or keying component, thereby disengaging the retaining element or keying component from a cooperating surface or recess in the packer body.

The valve seat may be one as described in International Patent Application PCT/GB2005/001662 to the Applicant, the disclosure of which is hereby incorporated by reference. Such a valve seat is elastically deformable, and may be made of a material such as PEEK (polyetheretherketone) or PAI (polyamide-imide). It will be recognised, however, that other polymeric materials with suitable elastic properties could be utilised. This allows the obturator, which may be a ball, to be "blown through" by a fluid pressure increase above that needed to displace the sleeve from the first to the second position. The sleeve may incorporate a downstream reduced diameter section to capture the ball, and fluid by-pass channels to allow fluid circulation around the reduced diameter section after the ball has been so captured.

According to a still further aspect of the present invention there is provided A method of drilling and testing a well bore comprising the steps of a) providing in a drill string, a compression or weight-set packer tool comprising a disengageable packer assembly wherein a packer sleeve bearing at least one compressible packer element around an outer surface of the sleeve is positioned upon a packer body such that relative movement of the body with respect to the packer sleeve is restrained by engagement of a selectively movable retaining element therebetween, running the drill string with the packer tool in a well bore until a shoulder which is on or is associated with a compression sleeve of the packer tool co-operates with a formation within the well, and setting down weight on the packer tool to compress the packer element and set the packer;

b) performing an inflow or negative test to test the integrity of the well bore;

c) introducing an obturator to a valve seat of an activation sleeve within the tool under gravity or by means of circulating fluid through the tool, and maintaining delivery of fluid to the tool to increase pressure upon the inner sleeve to move same within the throughbore from a first to a second position to cause movement of the selectively movable retaining element and thereby effect disengagement of the body from the outer packer sleeve; and d) resuming drilling within the well bore.

DESCRIPTION OF THE DRAWINGS

The invention will now be illustrated by way of example with reference to particular embodiments shown in the accompanying drawings in which.

Figure 1:
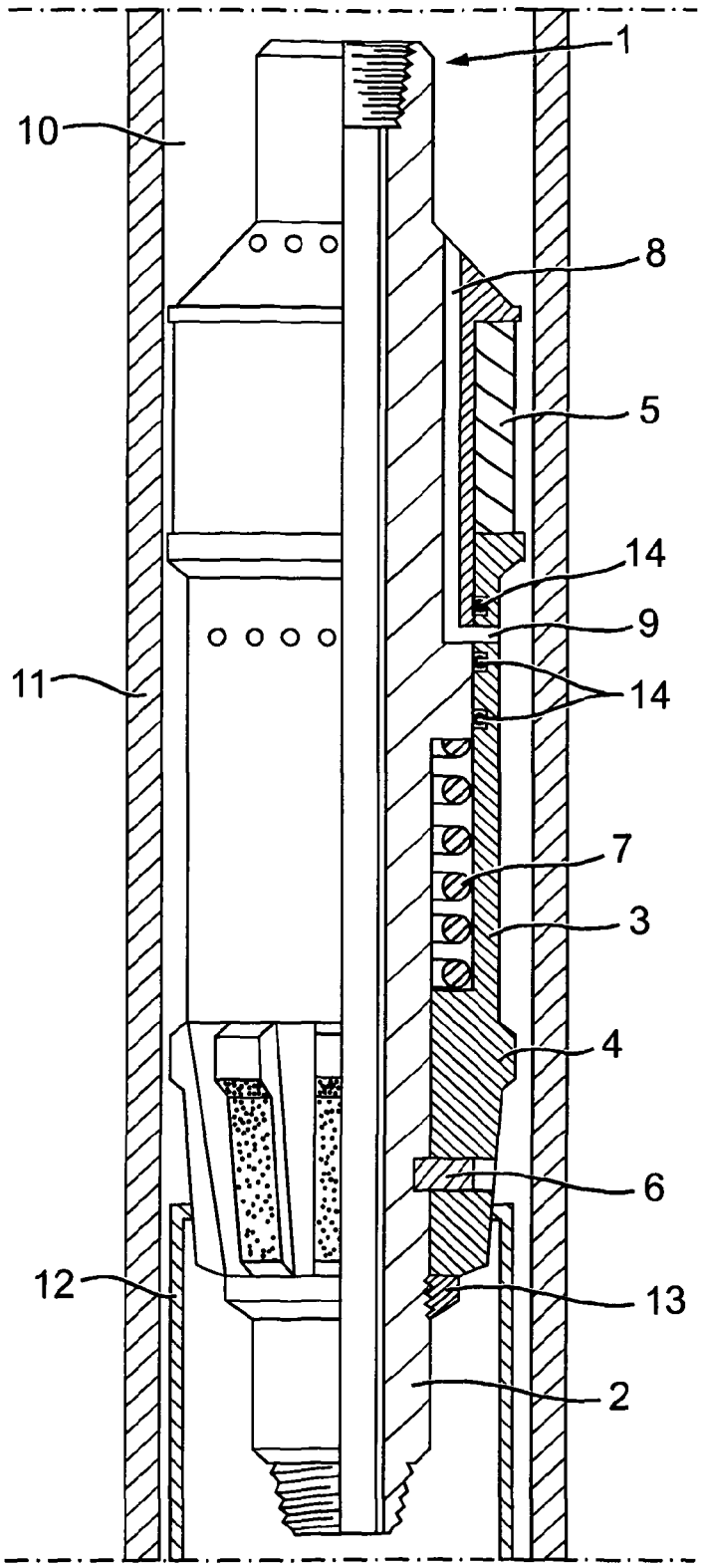
Fig. 1 (Prior Art)
FIG. 1 (prior art) illustrates a compression or weight-set packer tool as described in our U.S. Pat. No. 6,896,064 B2 being introduced to a well bore in proximity to a liner top.

Referring firstly to FIG. 1 (prior art) a compression or weight-set packer tool is generally depicted at 1 and comprises a packer body 2 and an outer compression sleeve 3 which is moveable in relation to the body 2. The body 2 is mounted on a work string (not shown), typically a drill pipe. The outer compression sleeve 3 has or is associated with a shoulder 4 which may be a liner top mill. The outer compression sleeve 3 is positioned substantially below one or more packer elements 5. The one or more packer elements 5 are typically made from a moulded rubber material. The outer sleeve 3 also has a retainer ring 13.

The outer sleeve 3 is mechanically attached to the body 2 of the tool 1 by one or more shear fasteners 6 and is biased by a spring 7. The body 2 of the tool 1 has an integral bypass channel 8 through which fluid can bypass the area around the packer elements 5, by flowing through the body 2 of the tool 1. The fluid then flows through a bypass port 9 in the sleeve 3. The integral bypass ports 9 and channel 8 are open when the tool is being advanced through a well bore 10, that is, before the tool 1 is set, and increase the fluid bypass area of the tool 1.

The tool 1 is mounted on a work string (not shown) and run into a pre-formed well bore 10. The pre-formed well bore 10 is lined by a casing string 11 and liner 12. The packer tool 1 is run through the bore 10 until the shoulder 4 rests on the top of the liner 12. Weight is then set down on the work string and attached tool 1, until the one or more shear fasteners 6, yield.

Shearing of the shear fasteners 6, releases the sleeve 3 from the body 2 of the tool 1, and allows the sleeve 3 to be moved relative to the body 2, by virtue of further weight set on the tool 1. In the depicted tool, shearing of the shear fasteners 6 allows the outer compression sleeve 3 to move in an upward direction relative to the body 2, although it will be appreciated that in an alternative embodiment the packer elements 5 may be located substantially below the sleeve 3 and the sleeve 3 may move in a downward direction relative to the tool body 2. As the outer compression sleeve 3 moves relative to the body 2, it compresses the one or more packer elements 5. Compression of the packer elements 5 distorts them from being fundamentally long and oblong in shape to squat and square in shape. As a result of the change in volume of the packer elements 5 the elements 5 come into contact with the casing 11 thereby sealing the annulus between the casing 5 and the tool 1.

Figure 2:
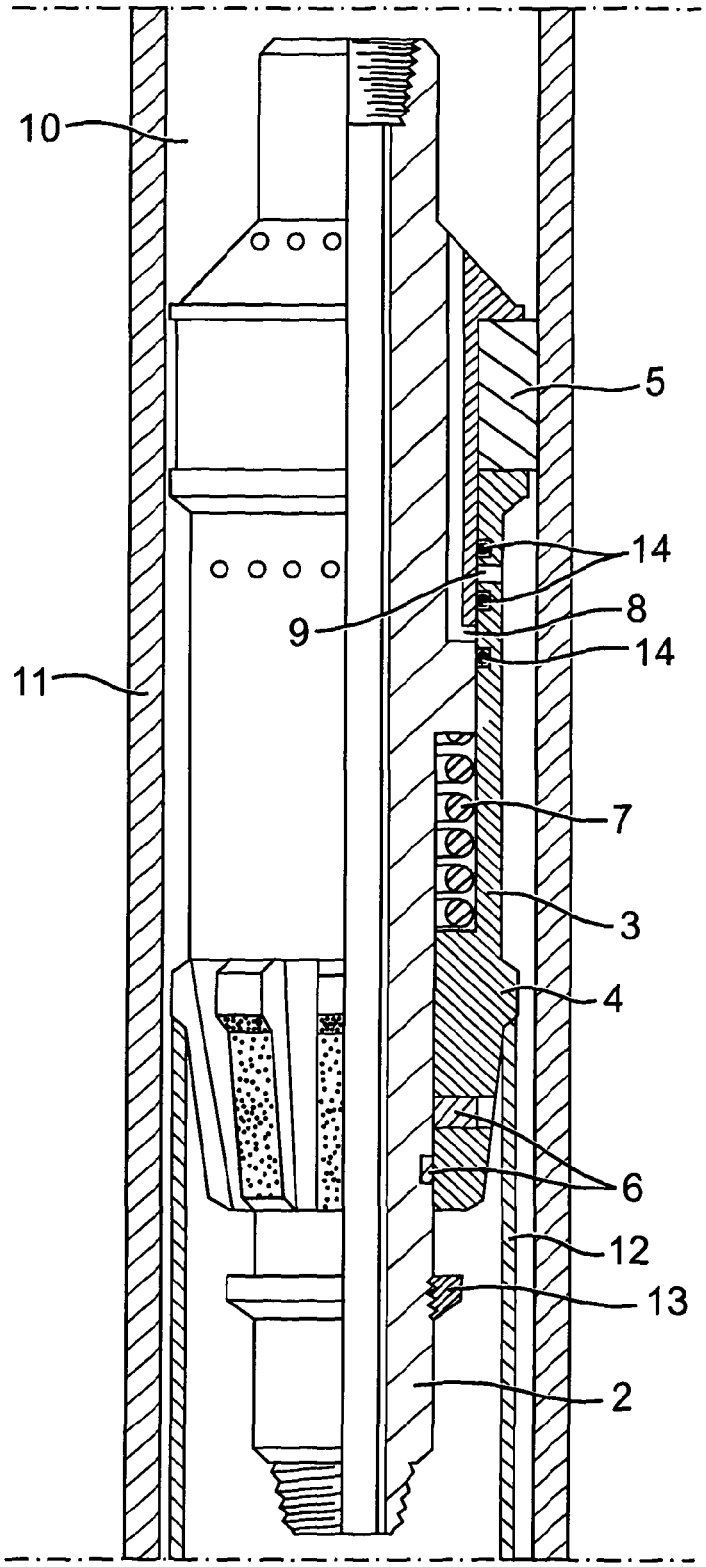
Fig. 2 (Prior Art)
FIG. 2 (prior art) illustrates the packer tool of FIG. 1 with set packer elements, and in position at the liner top.

This can be seen in more detail in FIG. 2, where the tool 1 is weight-set on the liner top 12 and the packer elements 5 are set. Movement of the compression sleeve 3 relative to the tool 1 causes the bypass port 9 to move out of alignment from the bypass channel 8 via the actions of seals 14. This prevents fluid from circulating through the ports 9 and channel 8.

Upon setting the packer tool 1 an inflow negative test can be carried out to check the integrity of, for example, the cement bonds between tubular members and between casing connections. In order to achieve this task the work string (not shown) can be filled with water or a similar low density fluid. This lower density fluid exerts a lower hydrostatic pressure within the drill pipe than the drilling fluid which is usually circulated through the pipe. If there are any irregularities in the cement bonds between casing members in the well bore, the drop in hydrostatic pressure created by circulation of a low density fluid will allow well bore fluids to flow into the bore lining. If this occurs an increase in pressure is recorded within the bore. This can be achieved by opening the drill pipe at the surface and monitoring for an increase in pressure which will occur if fluid flows into the bore. This allows any irregularities in the bore lining to be identified.

After the inflow or negative test has been carried out, the drill pipe (not shown) can be picked up and the spring 7 which exerts a downward bias on the sleeve 3, will return the sleeve 3 to its original position relative to the body 2 of the tool 1. Movement of the sleeve 3 in a downward direction removes the compression on the packer elements 5, which will relax and return to their original shape. The bore may then be pressured up to remove the well bore fluid, if any, which has passed into the bore and finally a heavy drilling fluid can be passed through the work string 1 to return the hydrostatic pressure to normal. The packer can be set and re-set repeatedly when required.

DESCRIPTION OF EMBODIMENTS OF THE INVENTION

Figure 3A:
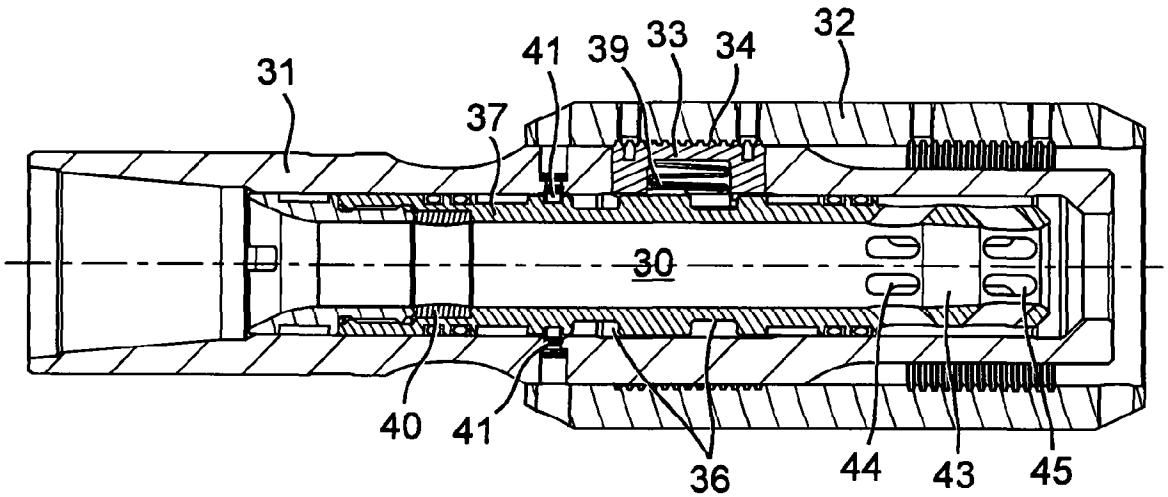
FIG. 3*a* illustrates in longitudinal section a disengageable packer release mechanism for use in a first embodiment of the invention in "run-in" configuration prior to setting of the packer.
Figure 3B:
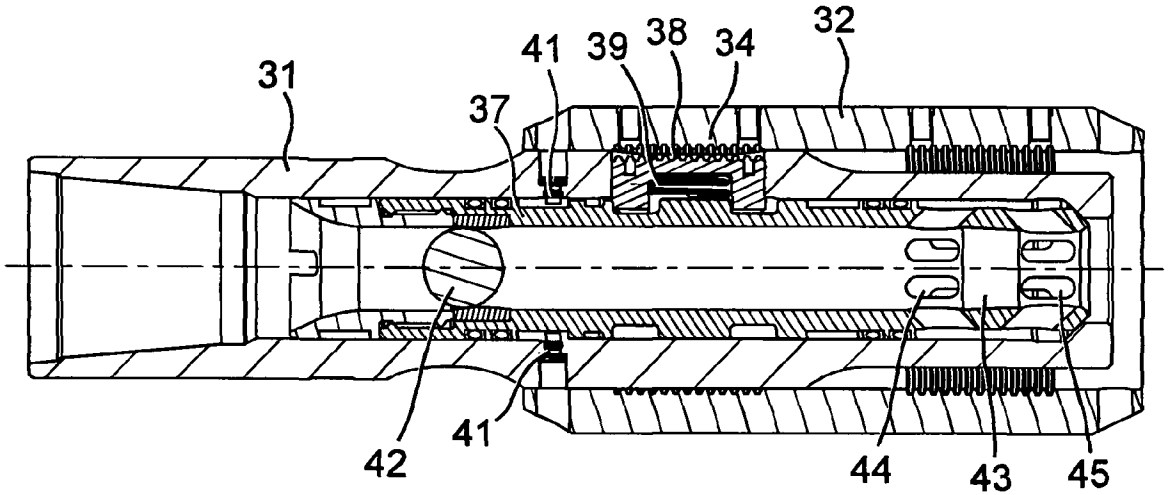
FIG. 3*b* illustrates in longitudinal section the disengageable packer release mechanism of FIG. 3*a* in disengaged configuration to allow drilling to be resumed.

Referring to FIGS. 3*a* and 3*b*, a disengageable packer assembly adapted for attachment to a drill string having an axial throughbore throughout its length (not shown), comprises a packer body 31 having a corresponding throughbore 30, connectable to the drill string (not shown), and an external packer support sleeve 32 positioned upon the packer body 31. The packer body 31 is capable of supporting at least one compressible packer element (not shown) upon an outer surface of the packer support sleeve 32.

The packer body 31 and the packer sleeve 32 are configured and assembled such that axial displacement of the packer body with respect to the packer sleeve is initially locked by mounting within the packer body 31 an inwardly and radially displaceable locking component, in this embodiment taking the form of shoe 33 with a ridged outer surface 34 adapted to contact and fit with a correspondingly grooved inner surface 38 in the packer sleeve 32. Additionally, the outer components can be locked to the body in the current design initially against rotation by a lower splined clutch arrangement (not shown) which would be also suitable for use in any embodiment of the tool.

The inwardly and radially displaceable shoe 33 is controlled, firstly by provision within the packer body 31 of an axially displaceable inner sleeve 37 configured with a recessed surface 36 adapted to accommodate at least inner projecting parts of the shoe whenever the axially displaceable inner sleeve 37 is moved within the packer body 31 a certain distance, and secondly by provision of biasing means such as a retention spring 39 designed to retract the shoe 33 once the inner sleeve 37 is displaced appropriately. In this way the shoe can be retracted to remove the contact between the packer body 31 and the packer sleeve 32 and thereby disengage the packer tool assembly from the drill string.

Axial displacement of the inner sleeve 37 from a first position to a second position within the packer assembly is realised by provision of a valve seat 40 positioned towards an upstream end of the sleeve 37 and aligned within the throughbore to receive an obturator, e.g. ball 42 delivered thereto under gravity or by circulation of fluid through the tool.

Shearable fasteners 41 retain the inner sleeve 37 in a predetermined axial position within the packer assembly during run in and prior to activation of the packer assembly disengagement functionality. These shearable fasteners 41 are designed to yield at a predetermined fluid pressure within the throughbore that can be developed upon the ball/seat combination. Thus as is known in the art the timing of the activation of the disengagement functionality can be determined by "dropping a ball" into the circulation fluid to deliver same to the valve seat and subsequently observing and controlling fluid pressure. A pressure change will be observed when the shearable fasteners 41 yield.

The seat 40 is of a resin material e.g. Torlon ® of Solvay for an unreinforced, lubricated, pigmented grade of polyamide-imide (PAI) resin, that is deformable to permit the ball 42 to be blown through the seat by application of higher fluid pressures than that necessary to cause the shearable fasteners to yield. In this way fluid circulation can be resumed through the tool. In other embodiments, a deformable ball may be used with a non-deformable seat to achieve the same objective.

In this embodiment, a "ball catcher" in the form of downstream bore restriction 43 within the inner sleeve 37 is positioned in the throughbore to receive a ball 42 that has been so blown through the valve seat. By-pass channels 44, and 45, are located around the bore restriction to ensure that fluid circulation is permitted around the "caught" ball.

In use, the disengageable packer assembly is made up in a drill string with a compression packer tool such as that shown in FIGS. 1 and 2, and run in a well bore during a well bore drilling operation. It will be understood that the well bore is partially drilled and cased progressively, and at some stage it is desired to conduct an integrity test for the work done so far e.g. to test whether cementing operations have been successful in forming the required seals around casing, and whether casing joints are liable to leak well bore fluids etc. The packer tool will be activated to enable such an integrity test (inflow or negative test) to be performed. As described above under discussion of the known art, the compression packer is set by setting down weight on the tool to compress the packer elements into contact with the liner top under test. The test is conducted as described hereinbefore. The packer can be unset by raising the drill string to back off sufficiently to remove the weight set allow the compressed packer elements to relax from the compressed state.

In the case where drilling operations are to be resumed immediately after the test, the packer element/sleeve part assembly may be disengaged from the packer body mounted within the drill string by introducing a ball in the circulating fluid to seat within the inner sleeve of the packer assembly bringing about a temporary pressure increase, and causing the shear fasteners to yield, releasing the inner sleeve to advance to the second position. This achieves the objective of removing the possibility of the packer elements hindering subsequent drilling operations to be conducted directly after testing of the wellbore.

Figure 4A:
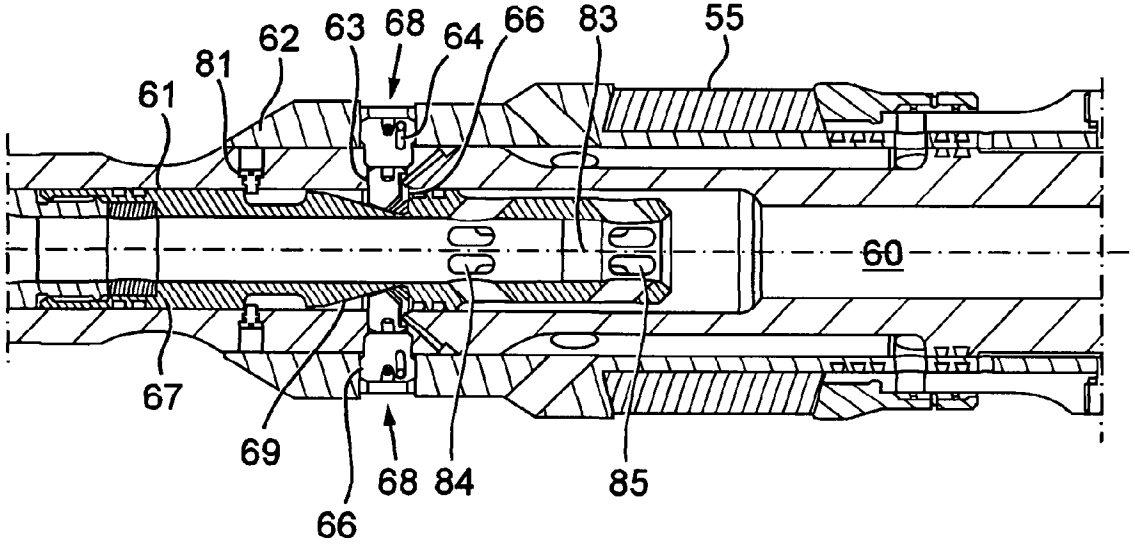
FIG. 4*a* illustrates in longitudinal section a disengageable packer assembly according to a second embodiment of the invention in "run-in" configuration prior to setting of the packer.
Figure 4B:
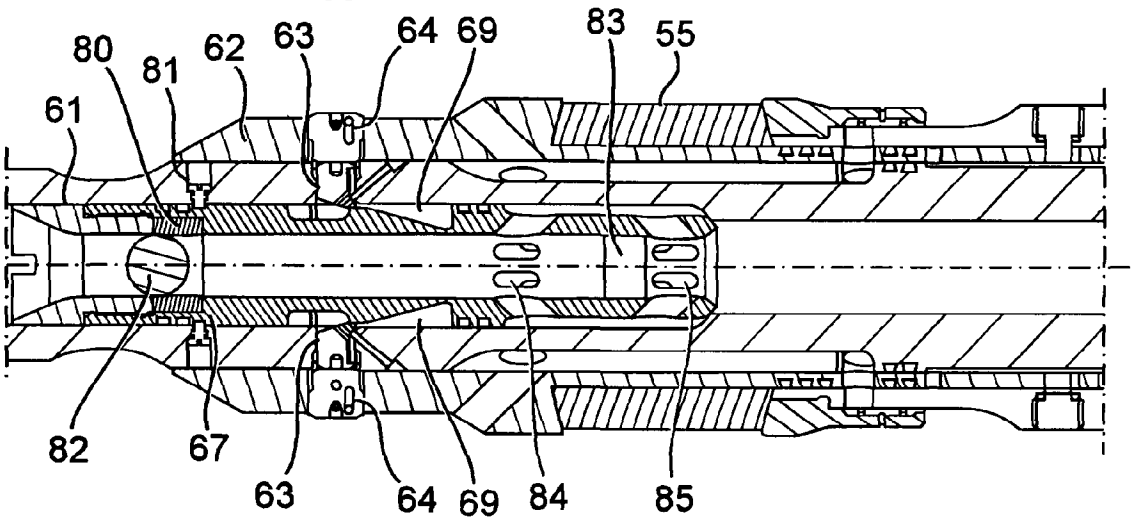
FIG. 4*b* illustrates in longitudinal section the disengageable packer assembly of FIG. 4*a* in disengaged configuration to allow drilling to be resumed.

Referring now to FIGS. 4*a* & 4*b*, an alternative embodiment of the disengageable packer assembly will be described. As before, the disengageable packer assembly is adapted for attachment to a drill string having an axial throughbore throughout its length, and comprises a packer body 61 having a corresponding throughbore 60, connectable to the drill string (not shown), and an external packer support sleeve 62 positioned upon the packer body 61. The packer body 61 is capable of supporting at least one compressible packer element 55 upon an outer surface of the packer support sleeve 62.

The packer body 61 and the packer sleeve 62 are configured and assembled such that initially for run-in and setting of the packer tool, mutual axial displacement is resisted but relative movement of the packer body 61 with respect to the packer sleeve 62 is selectively controlled by mounting within the packer body 61 an inwardly and radially displaceable retaining element, in this embodiment taking the form of superposed elements 63, 64 adapted to engage with corresponding apertures 66, 68 in the packer sleeve 62. Outer block 64 is configured to partially penetrate the aperture 66 e.g. by provision of a diameter step change on the block and/or in the recess, and is normally positioned at the outset to be only partially received into outer aperture 68 when the packer body 61 and packer sleeve 62 are engaged, thereby providing a projection bridging between the apertures 66, 68 that resists axial displacement of the packer body 61 with respect to the packer sleeve 62.

The inwardly and radially displaceable superposed elements 63, 64 are controlled, firstly by provision within the packer body 61 of an axially displaceable inner sleeve 67 configured with a wedge or ramped surface 69 adapted to engage an inner surface of inner pin 63, these together acting as a cam and follower, with pin 63 acting as a push rod upon block 64. Thus as the axially displaceable inner sleeve 67 is moved within the packer body 61 a certain distance, the pin 63 is forced radially outwards as the wedge or ramped surface is displaced (to the right in FIGS. 4*a*, 4*b*). In this way the outer block 64 is pushed radially outwards until clearing the aperture 66, such that the interface between the contacting surfaces of the elements 63, 64 coincides with the interface between the packer body 61 and the packer sleeve 62, thereby removing the retaining projection therebetween to disengage the packer sleeve from the drill string.

Axial displacement of the inner sleeve 67 from a first position to a second position within the packer assembly is realised by provision of a valve seat 80 positioned towards an upstream end of the sleeve 67 and aligned within the throughbore to receive an obturator, e.g. ball 82 delivered thereto under gravity or by circulation of fluid through the tool.

Shearable fasteners 81 retain the inner sleeve 67 in a predetermined axial position within the packer assembly during run in and prior to activation of the packer assembly disengagement functionality. These shearable fasteners 81 are designed to yield at a predetermined fluid pressure within the throughbore that can be developed upon the ball/seat combination. Thus as is known in the art the timing of the activation of the disengagement functionality can be determined by "dropping a ball" into the circulation fluid to deliver same to the valve seat and subsequently observing and controlling fluid pressure. A pressure change will be observed when the shearable fasteners 81 yield.

The seat 80 is of a material e.g. PAI or PEEK that is deformable to permit the ball 82 to be blown through the seat by application of higher fluid pressures than that necessary to cause the shearable fasteners to yield. In this way fluid circulation can be resumed through the tool. In other embodiments, a deformable ball may be used with a non-deformable seat to achieve the same objective.

In this embodiment, a "ball catcher" in the form of downstream bore restriction 83 within the inner sleeve 67 is positioned in the throughbore to receive a ball 82 that has been so blown through the valve seat. By-pass channels 84, and 85, are located around the bore restriction to ensure that fluid circulation is permitted around the "caught" ball.

In use, the disengageable packer assembly is made up in a drill string with a compression packer tool such as that shown in FIGS. 1 and 2, and run in a well bore during a well bore drilling operation as described for the previous embodiment.

Figure 5:
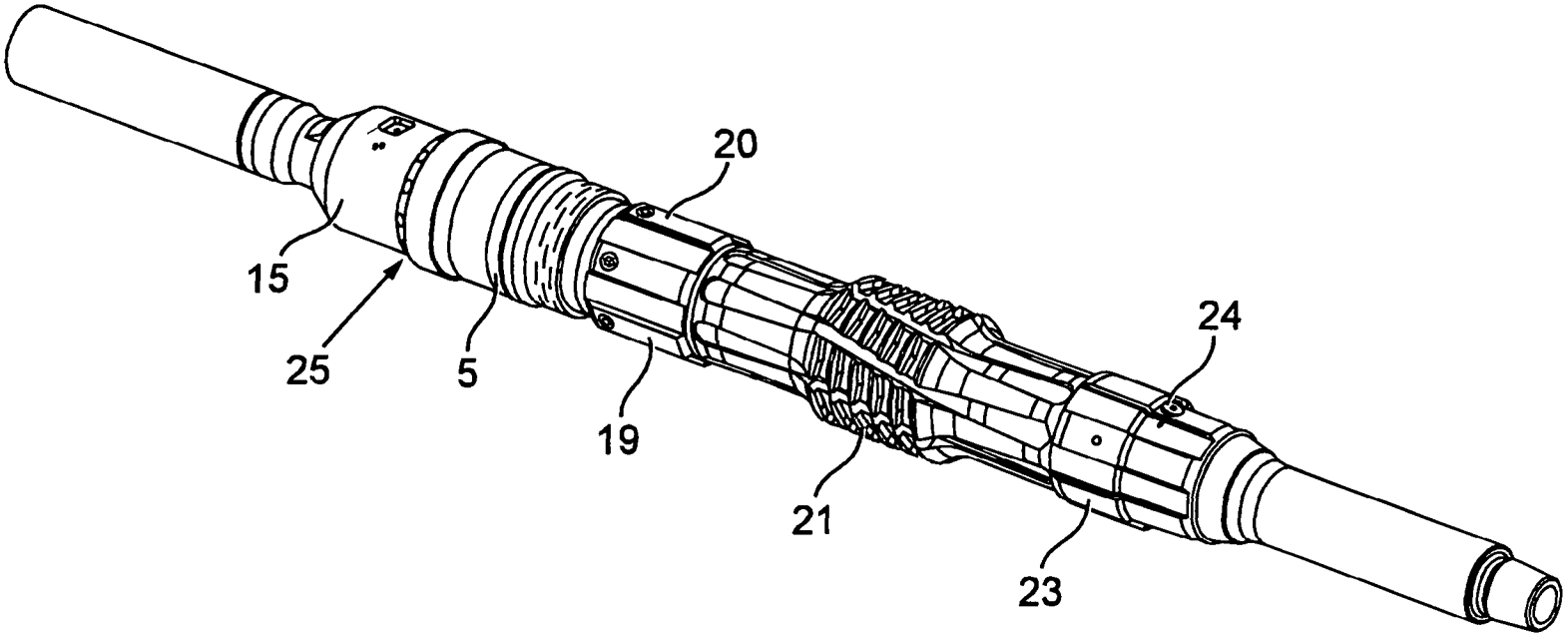
FIG. 5 illustrates a perspective view of a compression or weight-set packer tool including a disengageable packer assembly according to the invention.

Referring to FIG. 5, a disengageable packer assembly as in either of the previously described embodiments is made up with a packer tool 25.

Packer tool 25 comprises a one piece full strength drill pipe mandrel having a longitudinal bore therethrough. A box section connection is located at a top end of the mandrel and a threaded pin section is located at a bottom end of the mandrel, respectively enabling make up with other tool subs and upper and lower sections of a drill pipe as is understood in the art.

Mounted on the mandrel 15 is a packer with compressible packer element 5, as described hereinbefore with reference to FIGS. 1 and 2. Below the packer is located a stabiliser sleeve 19. Sleeve 19 is rotatable with respect to the mandrel 15. Raised portions or blades 20 on the sleeve 19 provide a "stand-off" for the tool 25 from the walls of the well bore and a lower torque to the tool 25 during insertion into the well bore.

Located below the stabiliser sleeve 19 is a Razor Back Lantern ® 21. This Razor Back Lantern ® provides a set of scrapers for cleaning the well bore prior to setting the packer 5. Though scrapers are shown, a brushing tool such as a Bristle Back ® could be used instead or in addition to the scrapers.

The shoulder for operating the compression sleeve of the packer is located on a top dress mill 23 at the lower end of the tool 25. A safety trip button 24 is positioned just below the shoulder. Operation of the packer tool 25 via the sleeve is as described hereinbefore.

Normally, the packer tool 25 includes a safety device option which addresses the potential risk of premature activation of the packer tool before it is run into hole to the desired test location. A suitable safety device includes a depressible button element designed to yield under shear loading only when the tool is properly presented downhole to the shoulder within the wellbore for activation of the compression packer element usually when presented into the polished bore receptacle at the liner top. As a result of the "drill-ahead" enablement provided by the current invention, it is possible that a sheared part of the safety device, normally confined within the retrievable packer tool might be released downhole upon drilling ahead due to the axial displacement of the drill string through the disengaged packer tool. This possibility can be addressed by modifying that part of the tool body housing the shearable element of the safety device to accommodate a retention device with different configurations. Such a device may be a machined spring which is fitted into the bottom of the shearable element of the safety device in a compressed configuration so that when the button is depressed after entering the PBR, the machined spring expands into appropriately formed retention recesses. This locks the lower part of the now sheared trip button to the main body of the tool so that upon drilling ahead the lower sheared part will not fall into the wellbore.

Further modification and improvements may be incorporated without departing from the scope of the invention herein intended.

The invention claimed is:

1. A packer comprising:

packer body having a corresponding throughbore;

an external packer sleeve, having an inner surface with a grooved section, positioned upon the packer body such that relative movement of the body with respect to the sleeve is restrained by a radially displaceable locking element comprising a shoe having a ridged outer surface adapted to interlock with the grooved section of the inner surface of the external packer sleeve; and a retention spring for selectively moving the shoe with respect to the external packer sleeve to disengage the displaceable locking element and allow movement of the packer body within the external packer sleeve.

2. The packer of claim 1 wherein the packer body is axially movable with respect to the external packer sleeve in response to a pressure event.

3. The packer of claim 2 wherein the packer body includes a valve seat adapted to receive an obturator that is deliverable to the seat through a drill string with circulating fluid, the combination of the obturator and seat in use allowing a pressure change to be realized.

4. A method comprising:

providing a compression packer tool comprising a disengageable packer assembly wherein a packer sleeve is positioned upon a packer body such that relative movement of the packer body with respect to the packer sleeve is restrained by engagement of a selectively radially movable retaining element therebetween, and wherein the movable retaining element comprises a spring biased shoe having a ridged outer surface adapted to interlock with a grooved section of an inner surface of the packer sleeve;

moving the packer tool in a well bore until a shoulder on the packer sleeve of the packer tool co-operates with a formation within the well;

performing an inflow or negative test to test the integrity of the well bore; and introducing an obturator to a valve seat of the packer body under gravity or by means of circulating fluid through the tool, and maintaining delivery of fluid to the tool to increase pressure upon the packer body to move the obturator within the throughbore from a first to a second position to cause movement of the shoe away from the grooved section of the inner surface of the packer sleeve and thereby effect disengagement of the packer body from the packer sleeve.

5. The method of claim 4 wherein the packer body is axially movable with respect to the external packer sleeve in response to a pressure event.

6. The method of claim 4 wherein the shoe is operably connected to a spring retention means configured to retract the shoe away from the grooved section of the inner surface of the packer sleeve.

* * * * *